US005788449A

United States Patent [19]

Riemersma

[11] Patent Number: 5,788,449

[45] Date of Patent: Aug. 4, 1998

[54] MASSAGER SYSTEM FOR A BULK BAG UNLOADER

[75] Inventor: Keith A. Riemersma, Holland, Mich.

[73] Assignee: National Bulk Equipment, Inc., Holland, Mich.

[21] Appl. No.: 834,730

[22] Filed: Apr. 3, 1997

[51] Int. Cl.[6] ..... B65G 65/23

[52] U.S. Cl. ..... 414/415; 222/103; 222/203

[58] Field of Search ..... 414/403, 411, 414/412, 415, 414, 404, 467, 523, 527, 607, 608; 220/1.5; 222/103, 203, 202, 105, 196, 181, 185; 254/93 R

[56] References Cited

U.S. PATENT DOCUMENTS

| | | | |
|---|---|---|---|
| 2,858,051 | 10/1958 | Cunningham | 222/103 |
| 4,810,156 | 3/1989 | Pendleton et al. | 222/203 X |
| 5,271,439 | 12/1993 | Alack | 222/103 X |

FOREIGN PATENT DOCUMENTS

| | | | |
|---|---|---|---|
| 1265097 | 10/1986 | U.S.S.R. | 222/203 |
| 2240965 | 8/1991 | United Kingdom | 222/203 |

*Primary Examiner*—Frank E. Werner

*Attorney, Agent, or Firm*—Flynn, Thiel, Boutell & Tanis, P.C.

[57] ABSTRACT

A massager system for facilitating the rapid unloading of bulk material stored in a semi-rigid bag. The system includes a frame from which the bag is suspended. The bag has a discharge spout in the bottom end thereof that is secured to a complementary hopper. The system includes two massager paddles that are seated against the bottom end of the bag on opposed sides of the hopper. The massager paddles are secured to the frame so as to be able to pivot upwardly. A single actuator, such as a pneumatic drive cylinder, is suspended directly from the massage paddles. The actuation of the drive cylinder causes the simultaneous upward movement of the paddles so that the paddles enhance the movement of the contents of the bag out through the bag discharge spout.

15 Claims, 6 Drawing Sheets

MASSAGER SYSTEM FOR A BULK BAG UNLOADER

FIELD OF THE INVENTION

This invention relates generally to a system for unloading bulk material from a flexible storage bag and, more particularly, to a system for unloading loose material utilizing the assistance provided by a set of massager paddles.

BACKGROUND OF THE INVENTION

The loose raw materials employed in many manufacturing processes are often transported and stored in large bulk containers before use. For example, in pharmaceutical manufacturing facilities, the raw chemicals are often in powder form. These powders are transported from their place of manufacture and are stored in large containers until they are loaded into processing equipment. Recently, it has become popular in the pharmaceutical manufacturing industry, as well as in other industries, to transport and store bulk material in large, semi-rigid plastic bags. It is the practice to form these bags to have main bodies that have generally rectangular shapes. This facilitates the storage of the greatest number of filled bags in a given space. Each bag is provided with a top opening through which it is filled. Each bag is further provided with a reduced diameter spout which, relative to the main body, extends downwardly therefrom. The end of the spout functions as the opening through which the bulk material, such as powder or plastic pellets as used in other industries, are discharged into a complementary hopper for transfer to the machinery in which it is processed. Often a bag is provided with a liner that surrounds the inside surface of the bag. The liner prevents the material stored in the bag from coming into contact with the bag. Once the bag is emptied, the liner is removed and the bag collapsed for transport back to a facility where it can again be loaded with bulk material. The refilling of the bag automatically returns the bag to its large, full capacity shape.

While the use of semi-rigid plastic bags has proved advantageous over the cardboard boxes which, in the past, were used as storage and transport containers, there are some problems associated with their use. One of the most significant problems has been that it has proven difficult to provide a means for easily unloading a bag to insure that all the material therein is removed. This has proven difficult because of the flexible nature of the bags makes it difficult to tilt them to ensure that all the contents in the lower portion of the bag can be accessed for removal. Moreover, if a bag has been left standing for an extended period of time, its contents may have become compressed together. If this occurs, gravity alone may not provide a sufficient force for drawing the contents out through the bag spout.

A number of different assemblies have been proposed for facilitating the removal of loose bulk material from large storage bags. U.S. patent application Ser. No. 08/757 923, filed Nov. 27, 1996, entitled System And Method For Unloading Bulk Material From A Semi-Rigid Container, owned by the assignee of this application, incorporated herein by reference, discloses an overhead bag hanger designed to draw the upright longitudinal edges of a bag together as the bag unloads. This system has, to a significant extent, facilitated to the complete emptying of a bag. However, if the contents of the bag are compressed together, their internal adhesion may still significantly slow the emptying of the bag. To overcome this problem a number of assemblies have been suggested for massaging the base or lower portions of the bag. These assemblies typically have two or more petals that are positioned to abut the bag. These petals are reciprocally actuated so as to break up direct the material in the bag towards the neck opening and to at least partially break up any large masses of material in the bag that may have formed together. For example, one such assembly (U.S. Pat. No. 4,810,156) has been provided with a number of pivoting petals that are located adjacent the bottom of the bag. Each petal is actuated by a separate air stroke actuator, or bellow. While these assembles have proven useful for facilitating the rapid emptying of large plastic bags, there are some disadvantages associated with their installation and use. Each petal must be provided with both its own bellow and a complementary set of control valves to control the inflation and deflation of the bellow. Moreover, it is further necessary to design the control system to ensure that the bellows are inflated and deflated in the correct sequence. Collectively, providing all these components makes can make it relatively costly to both provide and maintain this type of system.

SUMMARY OF THE INVENTION

This invention is directed to a new and improved system for massaging a large bulk storage bag to foster the rapid and complete emptying of the contents of the bag. More particularly, this invention is directed to a massager system for a bulk bag unloader that employs a minimal number of actuators in order to facilitate the unloading of the bag with which it is used.

The massager system of this invention includes at least one pair of massager paddles. In a preferred version of the invention, the paddles forming each pair of paddles are parallel aligned and spaced apart from each other and are positioned to abut the bottom surface of the bag with which the system is used. The paddles are attached to a complementary support frame so as to be able to freely pivot. An actuator, such as a pneumatic drive cylinder, is connected to the paddles. For example, in one preferred version of the invention, the base of the cylinder is attached to one paddle while a piston rod that extend out of the other end of the cylinder is attached to the complementary paddle. Compressed air is supplied to the cylinder so as to cause the cyclic extension and retraction of the piston rod.

When the massager system of this invention is actuated, the piston rod of the drive cylinder cyclically extends and retracts. Owing to the interconnection of the drive cylinder to the paddles, the movement of the piston rod causes the paddles to undergo a pivoting motion relative to the complementary support frame. This pivoting motion means that the paddles are cyclically forced against the bottom section of the bag so as to urge this portion of the bag, as well as the contents therein, towards the open discharge spout of the bag. This motion forces the contents in the bottom of the bag through the discharge spout so as to foster their rapid discharge from the bag.

The massager system of this invention thus serves to continually act against the bottom of the bag with which it is used to force its contents into and through the discharge spout. If, for any reason, the contents of the bag have adhered to themselves, the repetitive motion of the massager paddles continually breaks up these masses to further facilitate that they flow through the discharge spout. Moreover, still another feature of the massager system of this invention is that one actuator pivots both massager paddles. It is only necessary to provide a single set of control lines and control valves for regulating the state of this one actuator.

Collectively, this component minimization reduces the complexity and cost of both providing the massaging system of this invention and maintaining the system.

BRIEF DESCRIPTION OF THE DRAWINGS

The invention will be pointed out with particularity in the appended claims. The above and further advantages of the invention may be better understood by reference to the following detailed description taken in conjunction with the accompanying drawings, in which:

DETAILED DESCRIPTION

Figure 1:
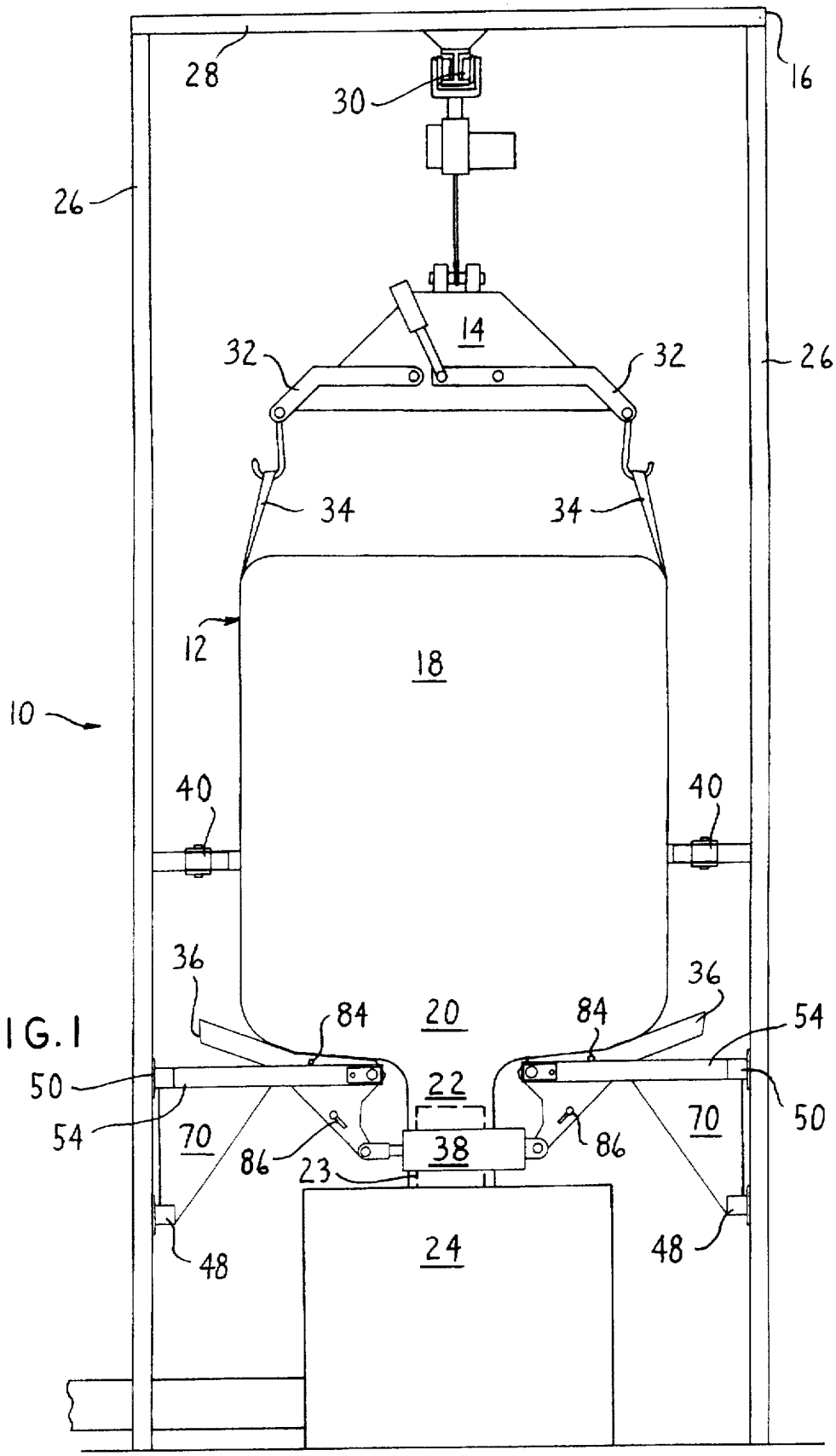
FIG. 1 is a side view of the massager system of this invention illustrating how the system is employed to facilitate the unloading of bulk material stored in a large bag.

FIG. 1 illustrates how a massager system 10 of this invention is used to facilitate the unloading of a bulk bag 12. The bag 12 is suspended from a bag hanger 14 that is secured to the top of a main frame 16. The bag 12 is formed to have a main body 18 that takes on a rectangular shape when the bag is substantially filled. The bag 12 when filled thus has a bottom section 20 that is formed with a downwardly extending discharge spout 22. The discharge spout 22 of the bag 12 is fitted around a complementary collar 23, (shown in phantom) that is part of a hopper 24. Typically a liner, not illustrated, is provided inside the bag 12 so as to separate the contents of the bag from the inner surface of the bag. Once the bag 12 is fitted to the hopper 24, an opening is formed in the liner so as to allow the contents of the bag to flow into the hopper.

The main frame 16 includes four upwardly extending legs 26. Horizontally extending cross beams 28 located at various elevations relative to ground level hold the legs together. The bag hanger 14 is secured to a I-shaped support beam 30 that is secured to the topmost positioned cross beams 28. The support beam 30 extends beyond the surface area subtended by the four legs 26 of the main frame 14. The bag hanger 14 is mounted to move along the length of the support beam 30 so as to facilitate the movement of the fully loaded bag 12 in position over the hopper 24. The bag hanger 14 has a set of arms 32 that are biased for an upwardly pivoting movement. The upper corners of the bag 12 are attached to the arms 32 by a set of straps 34 integral with the bag. As discussed in U.S. patent application Ser. No. 08/757,923, incorporated herein by reference, as the bag 12 is emptied, the arms 32 urge the bag upwards and its lateral edges inwardly so as to contribute to the complete and rapid unloading of the bag.

The massager system 10 includes two opposed paddles 36 that are positioned against the bottom section 20 of the bag 12 adjacent the discharge spout 22. A drive cylinder 38 is connected to the massager paddles 36. The actuation of the drive cylinder 38 causes the cyclic motion of the massager paddles 36 against the bag so as to urge the relatively planar bottom section 20 of the bag 12 towards the discharge spout 22. Also attached to the main frame 16 are a pair of hammer arms 40. As will be discussed hereinafter, the hammer arms 40 are also employed to break up aggregate masses of material formed in the bag 12 above the bottom section 20.

Figure 2:
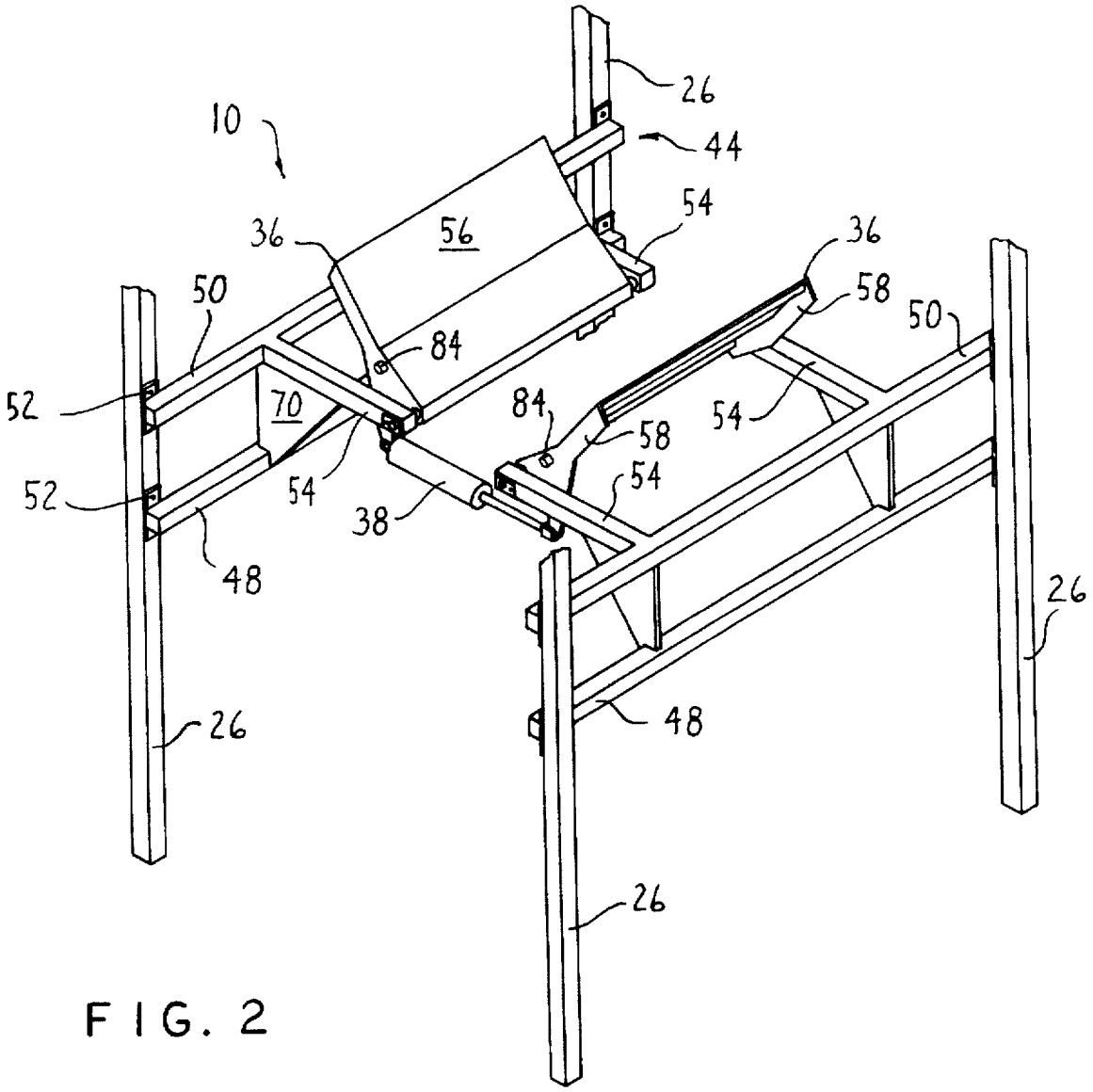
FIG. 2 is a perspective view of the primary components of the massager system of this invention.
Figure 3:
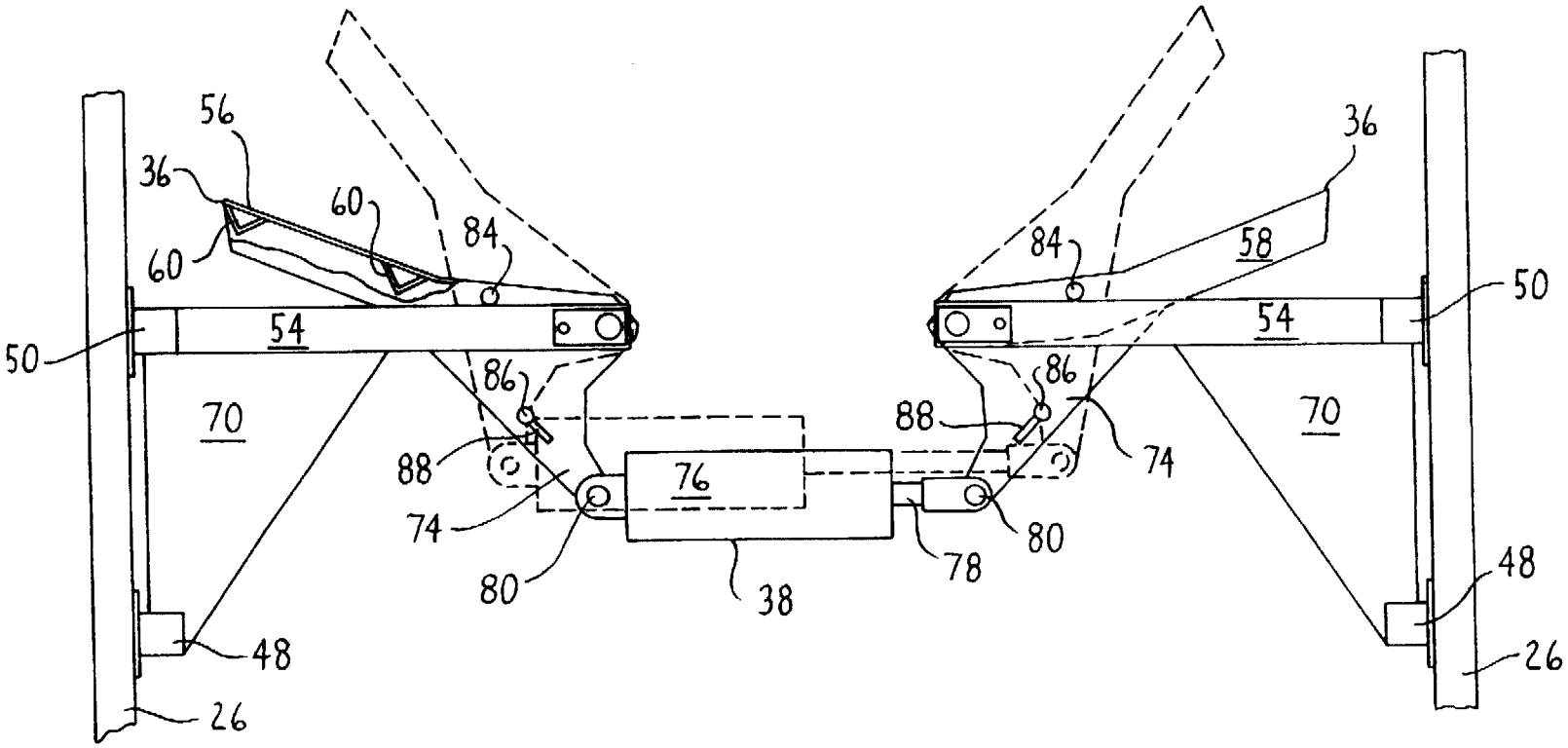
FIG. 3 is a side view of the primary view of the massager system of this invention showing the massager paddles in both their at-rest and extended states.
Figure 4:
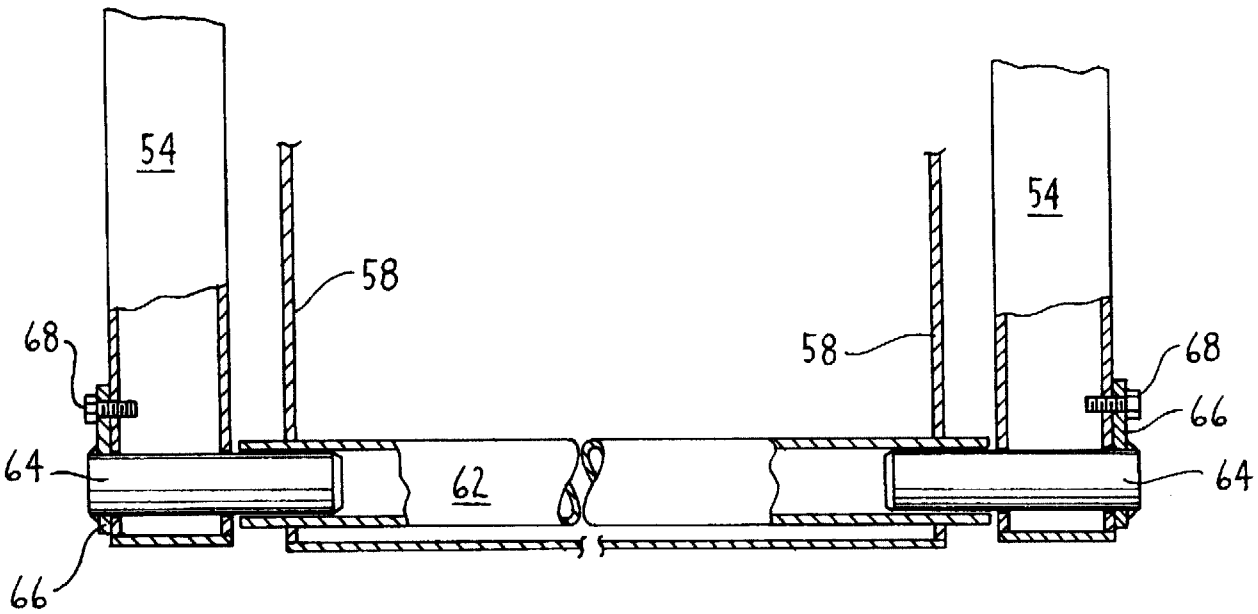
FIG. 4 is a cross section view illustrating how a massage paddle is secured to the other components of the system.

The massager system 10 of this invention is now described in detail by reference to FIGS. 2, 3 and 4. As depicted therein the massager system 10 includes a frame 44 that is formed out of two opposed lower cross members 48 and two opposed upper cross members 50. The cross members are arranged so that each upper cross member 50 is spaced a slight distance above a complementary one of the lower cross members 48. Mounting plates 52 are attached to the ends of the cross members 48 and 50. The mounting plates 52 facilitate the attachment of the frame 44 of the massaging system 10 to the legs 26 of the main frame 16.

The massager paddles 36 are pivotally attached at the opposed sides thereof to two arms 54. Each massager paddle 36 is shaped to have a relatively planar paddle plate 56. While these paddle plates 56 are generally planar, it can be observed that in some preferred versions of the invention it may be desirable to shape the paddle plates 56 to have a slight incline in the outer portions thereof so as to facilitate the inward movement of the bag 12 against which the paddle plates abut. Webs 58 extend downwardly along the opposed side edges of the paddle plate 56. Moreover, two cross braces 60 are attached to the undersurface of each paddle plate 56 so as to extend along the length of the paddle plate. Collectively, the webs 58 and cross braces 60 provide structure support for the massager paddle 36 since, as will be discussed hereafter, torque is only applied to one side of the paddle.

Each massager paddle 36 is further provided with a sleeve-like mounting tube 62 that extends along the length of the inner edge of the paddle plate 56 and slightly beyond the ends of the paddle. Stub shafts 64, which extend perpendicularly from each arm 54, are seated in the opposed ends of the mounting tube 62 to pivotally connect the massager paddle 36 to the arms. In one preferred version of the invention, the end of each stub shaft 64 distal from the massager paddle 36 is secured to a plate 66. The shafts 64 each extend through openings, not identified, formed in the associated arm 54. The associated plate 66 abuts the outer surface of the arm 64 and is secured thereto by a bolt 68.

The arms 54 that support the massager paddles 36 are supported by a triangularly shaped gussets 70. Each gusset 70 extends upwardly from each lower cross member 48 to the complementary upper cross member 50 and is integrally secured to the arm 54 with which it is associated.

The drive cylinder 38 is suspended from the opposed massager paddles 36. More particularly, it can best be observed from FIG. 3 that integral with one web 58 of each massager paddle 36 is a downwardly extending torque arm 74. The massager paddles 36 are shaped so that the torque arms 74 are aligned with each other. The drive cylinder 38 has a main body 76 which is supplied with the pressurized air. A piston rod 78 extends out of one end of the main body 76. The base of the drive cylinder main body 76, the end of the main body distal from the piston rod 78, is pivotally attached to one torque arm 74 by a first cylinder pin 80. The free end of the piston rod 78 is attached to the opposed torque arm 74 by a second cylinder pin 80.

In order to limit downward paddle movement, each massager paddle 36 is provided with a stud like downstop 84 that is attached to the web 58 integral with the torque arm 74. Each downstop 84 is positioned to abut the top surface of the adjacent support arm 54 once the associated massager paddle 36 retracts beyond an established angle. To limit upward movement, a stud-shaped upstop 86 is attached to each torque arm 74. The upstops 86 are positioned to abut the undersides of the support arms 54 with which they are adjacent when the paddles 36 pivot above a selected angle. A small, plate like gusset 88 is formed integrally with each upstop 86 in order to provide these components with support. While not illustrated, the downstops 84 may be provided with similar gussets.

Figure 5:
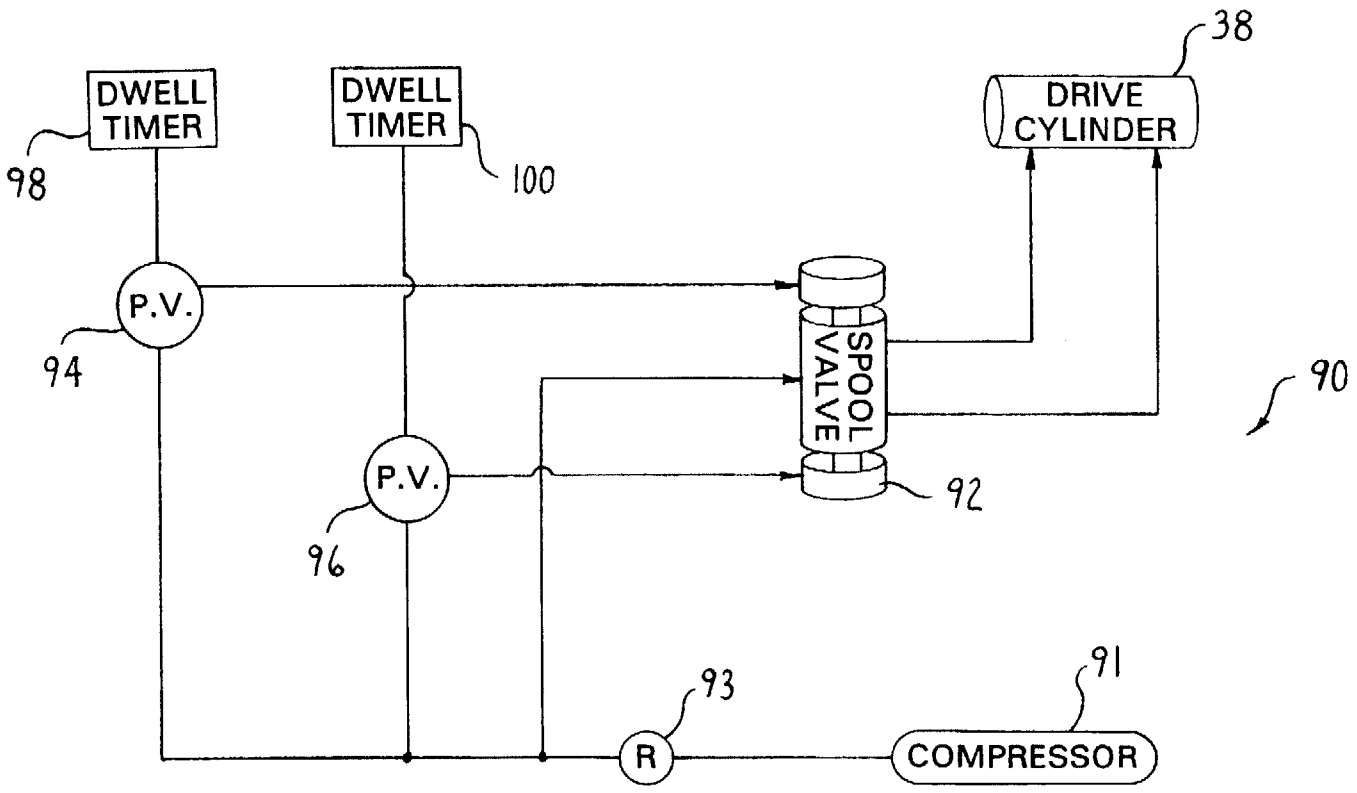
FIG. 5 is a block diagram of the control lines used to actuate the massager paddles.

FIG. 5 depicts a control system 90 that supplies pressurized air to the drive cylinder 38 in order to cause the actuation of the massager paddles 36. Pressurized air from a compressor 91 is supplied in order to charge the drive cylinder 38. A regulator 93 sets the pressure of the air downline from the compressor. In one preferred version of the invention, when the system is designed to facilitate the unloading of bags 12 having a net weight of up to 4,000 pounds, it has been found useful to supply the drive cylinder 38 with air having a pressure of approximately 80 psi. A pressure-set spool valve 92 selectively applies the pressurized air to the opposed ends of the body 76 of the drive cylinder 38. Spool valve 92 is configured so that at the times pressurized air is being applied to one side of the body 76 of the drive cylinder 38, the opposed side is open to the atmosphere. The state of the spool valve 92 is established by two pilot valves 94 and 96, each of which controls the flow of air to one end of the spool valve.

The open and closed states of the pilot valves 94 and 96 are controlled by dwell timers 98 and 100, respectively. More particularly, pilot valve 94 and complementary dwell timer 98 cooperate to control the application of air to the base end of the drive cylinder 38 so as to cause the upward extensions of the massager paddles 36. Pilot valve 96 and complementary dwell timer 100 cooperate to control the application of air to the rod end of the drive cylinder 38 so as to cause the downward retraction of the massager paddles. In some preferred versions of the invention, the dwell timer 98 is configured to trigger the setting of the spool valve 92 so that air is applied to the drive cylinder for a period of time extending between 10 and 60 seconds so as to cause the upward extension of the massager paddles 36. Dwell timer 100 is configured to trigger the setting of the spool valve 92 so that air is applied to the drive cylinder for a period of time extending between 10 and 60 seconds so as to cause the downward retraction of the massager paddles 36.

Figure 6:
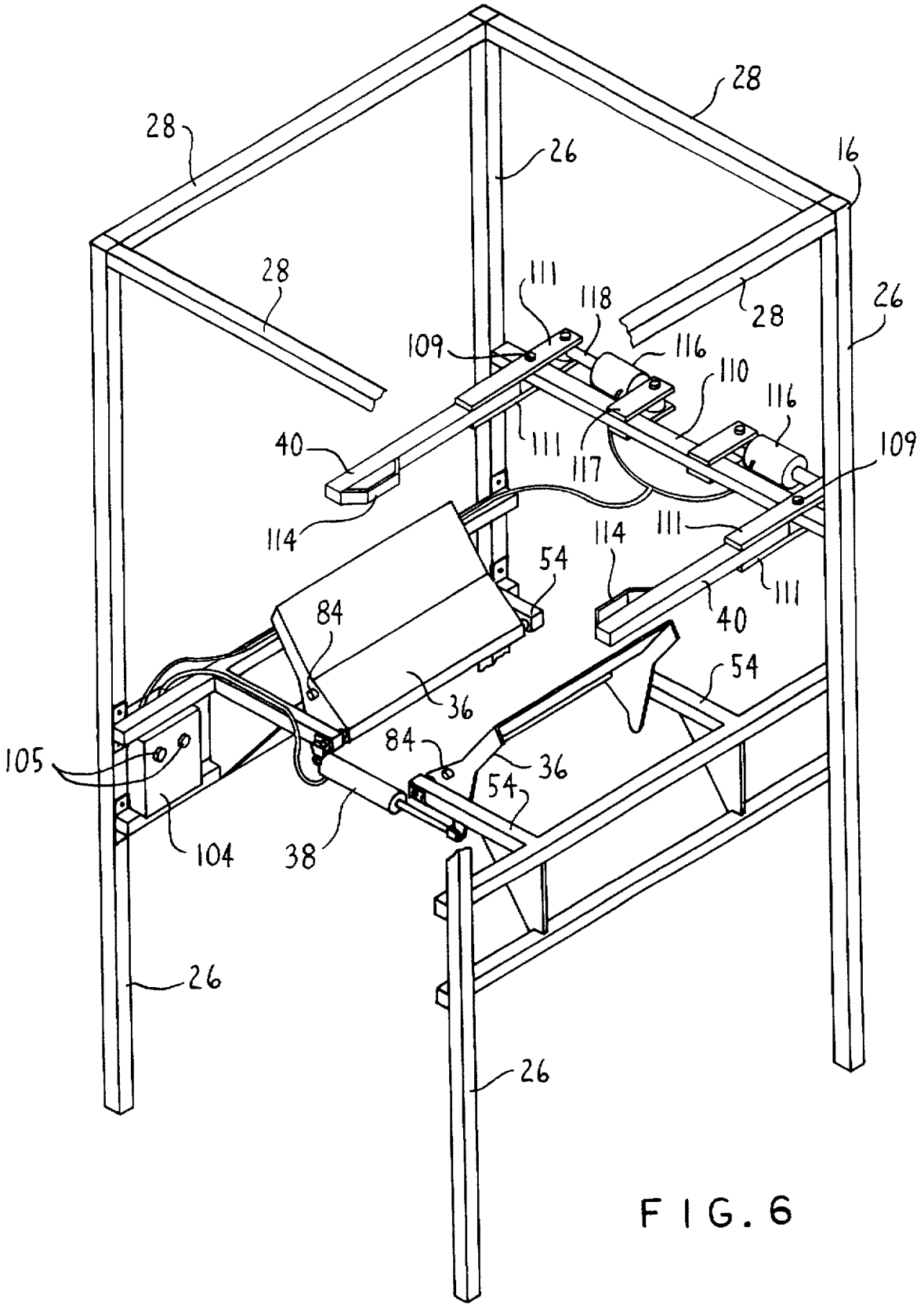
FIG. 6 is a perspective view of the massager system of this invention illustrating the hammer arms that can be further provided to facilitate the rapid unloading of a bag with which the system is used.

The spool valve 92, pilot valves 94, 96 and dwell timers 98, 100 are mounted in a control box 104 secured to the frame 44, (FIG. 6). The control box 104 is provided with a pair of buttons 105 that control the actuation of the system.

When the massager system 10 of this invention is actuated, pilot valves 94 and 96 are alternatively opened and closed by dwell timers 98 and 100, respectively, so as to cause the oscillation of the massager paddles 36. The upward movement of the paddles 36 forces the paddles against the bottom section 20 of the bag 12 with which the system is used. This motion urges the material in the bottom section 20 of the bag towards the center axis of the bag, towards the discharge spout 22, so that material in the bottom section will flow through the spout and into the hopper 24. The oscillatory motion of the massager paddles 36 breaks up large masses of material that may have bound together in the bag 12. The breaking up of this material further fosters the flow of the material from the bag 12.

In some instances, more material may be located on one side of the bag than on the opposed side. When this occurs, the massager paddle 36 working against the less loaded side of the bag 12 will move upwardly more rapidly than the associated paddle, i.e., the massager paddles 36 engage in simultaneous movement in the same direction that is asynchronous. The upward movement of this paddle 36 in this state, as in any state, ceases as a consequence of the upstop 86 moving against the adjacent support arm. Once the faster moving massager paddle 36 is so stopped, the complementary massager paddle 36 will continue to move upwardly until its movement is likewise blocked. Often, but not always, the up dwell timer 98 is set to hold both paddles in the fully extended position before the paddle retraction cycle is initiated.

Thus, the massager system 10 of this invention provides a convenient means for facilitating the rapid unloading of a bag 12 containing loose bulk material that is also economical to manufacture and is not particularly burdensome to install. A single drive cylinder 38 actuates the opposed drive paddles 36. Thus, the system 10 of this invention need not be provided with a costly set of twin actuators in order to foster the unloading of the bag. Moreover, the components of the massager system 10 of this invention, except the air compressor 91, are attached to the frame 44 that is suspended above ground level so that the system does not contribute to the surface clutter around the bag unloading station where it is installed.

FIG. 6 illustrates the hammer arms 40 that may also be installed as part of the massager system of this invention. Each hammer arm 40 is pivotally attached at one end to a cross member 110 that extends between two frame legs 26. Cross member 110 is located above frame 44 and is positioned to extend along an axis parallel to the axes of the massager paddle support arms 54. More particularly, each hammer arm 40 is bolted to two plates 111 that sandwich cross member 110 and extend a slight distance beyond the outer face of the cross member. The plates 111 are pivotally attached to the cross member 110 by a pin 109. A hammer plate 114 is secured to the forward inside surface of each hammer arm 40. The hammer plates 114 are the actual elements of the hammer arms 40 that strike the adjacent bag 12.

The hammer arms 40 are oscillated in a pivoting motion by drive cylinders 116. Each drive cylinder is connected at the base end thereof to a pair of support plates 117 that extend from cross member 110. The drive cylinders have piston rods 118 integral therewith that are reciprocally extended and retracted as a result of the application of compressed air to the opposed sides of the cylinders. Each piston rod 118 is connected at its distal end to the outwardly extending portions of the plates 111 integral with hammer arms of the associated hammer arm 40. A pneumatic air control system, not illustrated, similar to the system 90 used for supplying air to the drive cylinder 38 that was described with respect to FIG. 5, is employed to cyclically supply air to the opposed sides of drive cylinders 116 in order to cause the pivoting motion of the hammer arms 40.

The actuation of the hammer arms 40 causes the arms to cyclically strike the sides of the bag 12 above the massager paddles. In some preferred versions of the invention, the hammer arms 40 are actuated immediately after the bag 12 is opened and prior to the actuation of the massager paddles 40. In these versions of the invention, the hammer arms 40 thus break up aggregate masses of the material that may have formed in the bag 12 above the bottom section 20. Thus, the hammer arms break up any aggregate masses that bridge over the discharge spout 22 and block the flow of the material out of the spout.

In still other versions of the invention, it may be desirable to operate the hammer arms 40 in conjunction with the massager paddles 36 so that as the massager paddles return to their retracted states, the hammer arms move inwardly to break up the material above the bottom surface of the bag 12.

It should be recognized that the foregoing description is limited to several preferred versions of the invention. It should be clear, however, that the structure of the invention may differ from what has been described and illustrated. For example, in the disclosed embodiment, each massager paddle 36 is connected to two support arms 54. In other versions of the invention, each massager paddle may be connected to one or three or more support arms. Similarly, while in the illustrated version of the invention only two massager paddles are provided, in other versions, three, four more paddles may be provided. In these versions of the invention, linkages connected between the paddles can facilitate the actuation of the paddles by a single drive actuator.

Also, there is no requirement that in each version of the invention, the drive actuator be an pneumatic drive cylinder. In other versions of the invention, a hydraulic cylinder or even an electrically driven motor may be employed. Furthermore, the paddles need not be connected to the associated actuator in such a manner that they each engage in the same motion at the same time. Thus, it may be desirable that in some versions of the invention that the massager paddles and the associated actuator are connected together so that during a first time period one paddle will extend upwardly and while the second paddle will retract; in a second time period the first paddle with retract while the second paddle will extend. This arrangement may be desirable to facilitate the breaking up of some types of material. Furthermore, the paddles could be configured to allow the user to decide whether or not to allow the paddles to move together or in opposite directions. These versions of the system could be used to first maintain the material in the bag in a loose state and, then, to foster its rapid discharge from the bag 12. It should similarly be understood that while in the described versions of the invention a single actuator is employed to displace the massager paddles, that need not always be the case. In some versions of the invention a second actuator may be connected to the paddles so as to cause their inward and upward movement toward the discharge opening formed in the bag with which the system of this invention is used.

Moreover, it should be recognized that in other versions of the invention, it may be possible to provide the hammer arms with constructions different from that which has been described. For example, when it is anticipated that the unloading system of this invention will be used to facilitate the unloading of material that breaks apart relatively easily, a manual system may be provided for pivoting the hammer arms. This would eliminate the need to provide the drive cylinders 110. Similarly, in some versions of the system used to unload relatively tall bags, multiple sets of vertically spaced hammer arms may be secured to the main frame 16 at different locations relative to ground level. Also there is no requirement that the hammer arms be aligned with the longitudinal axes of the massager plates. In alternative versions of the invention, these components may be oriented perpendicularly from each other.

Thus, it should be recognized that it is the object of the appended claims to cover all such variations and modifications that come within the true spirit and scope of the invention.

The embodiments of the invention in which an exclusive property or privilege is claimed are defined as follows:

1. A massager system for facilitating the unloading of a bag containing bulk material, the bag being formed to have a bottom section with a discharge opening from which the bulk material flows from the bag in a vertical path, said massager system including:

a frame for suspending the bag so that the bottom section thereof is located above ground level;

two massager paddles attached to said frame and being generally horizontally oriented so that an upwardly facing surface of each thereof is located against the bottom section of the bag and on opposite sides of the vertical path, said massager paddles being also positioned to at least partially surround the discharge opening in the bag and, wherein said massager paddles are pivotally attached to said frame so as to pivot about a pivot axis towards the discharge opening;

an elongate torque arm fixed to and extending in a vertical direction from each said massager paddle on a side of said respective pivot axis remote from said massager paddle, each said torque arm being oriented in directly opposing relation for movement toward and away from each other about said respective pivot axes; and a single actuator connected directly to both said torque arms at a location spaced vertically from said pivot axes for simultaneously displacing said torque arms and said massager paddles.

2. The massager system of claim 1, wherein said actuator is connected to said torque arms for causing said massager paddles, when said torque arms are urged away from one another, to simultaneously pivot upwardly and towards the discharge opening in the bag and, when said torque arms are urged towards one another, to simultaneously retract away from the discharge opening in the bag.

3. The massager system of claim 1, wherein: said actuator displaces said torque arms so that said massager paddles engage in simultaneous asynchronous movement towards the bag discharge opening and in simultaneous, asynchronous movement away from the bag discharge opening; each said torque arm is provided with an upstop positioned to abut said frame so as to limit paddle movement toward the bag discharge opening; and each said massager paddle is provided with a downstop positioned to abut said frame to limit paddle movement from the bag discharge opening.

4. The massager system of claim 1, wherein: each said torque arm is provided with an upstop positioned to abut said frame so as to limit massager paddle movement toward the bag discharge opening; and each said massager paddle is provided with a downstop positioned to abut said frame to limit paddle movement from the bag discharge opening.

5. The massager system of claim 4, wherein said actuator includes means for maintaining said massager paddles in a maximum position towards the bag discharge opening after movement of said massager paddles is blocked by said upstops.

6. The massager system of claim 1, further including at least one hammer arm pivotally attached to said frame above said massager paddles, said at least one hammer arm having a hammer paddle positioned to selectively abut against a sidewall of the bag.

7. The massager system of claim 1, wherein: each said massager paddle is provided with a pair of spaced sides that extend from a forward edge of said massager paddle proximal to the discharge opening in the bag to a rear edge of said massager paddle distal from the discharge opening; said massager paddles are aligned with each other so that said sides of said massager paddles are aligned with each other; said torque arm on each massager paddle being an extension of a respective one of the sides; and said actuator extends from said torque arm of one said side to the aligned torque arm of the other said side.

8. A massager system for facilitating the unloading of a bag containing bulk material, the bag being formed to have a bottom section with a discharge opening from which the bulk material flows from the bag in a vertical path, said massager system including:

a frame for suspending the bag so that the bottom section thereof is located above ground level;

two massager paddles that are attached to said frame and being generally horizontally oriented so that an upwardly facing surface of each thereof is located against the bottom section of the bag and on opposite sides of the vertical path, said massager paddles being also positioned to at least partially surround the discharge opening in the bag and, wherein said massager paddles are pivotally attached to said frame so as to pivot about a pivot axis towards the discharge opening;

an elongate torque arm fixed to and extending in a vertical direction from each said massager paddle on a side of said respective pivot axis remote from said massager paddle, each said torque arm being oriented in directly opposing relation for movement toward and away from each other about said respective pivot axes; and a single actuator suspended directly from said two torque arms at a location spaced vertically from said pivot axes for simultaneously displacing said torque arms and said massager paddles.

9. The massager system of claim 8, wherein: each said torque arm is provided with an upstop positioned to abut said frame so as to limit massager paddle movement toward the bag discharge opening; each said massager paddle is provided with a downstop positioned to abut said frame to limit paddle movement from the bag discharge opening; and said actuator displaces said massager paddles so that said massager paddles engage in simultaneous, asynchronous movement towards the bag discharge opening that is limited by said upstops and in simultaneous, asynchronous movement away from the bag discharge opening that is limited by said downstops.

10. The massager system of claim 8, further including at least one hammer arm pivotally attached to said frame above said massager paddles, said at least one hammer arm having a hammer paddle positioned to selectively abut against a sidewall of the bag.

11. The massager system of claim 8, wherein each said massager paddle includes a massager plate that abuts the bottom section of the bag and said massager plates are formed to have non-planar surfaces.

12. A massager system for facilitating the unloading of a bag containing bulk material, the bag being formed to have a bottom section with a discharge opening from which the bulk material flows from the bag, said massager system including:

a frame for suspending the bag so that the bottom section thereof is located above ground level;

two parallel aligned massager paddles that are pivotally attached to said frame and being generally horizontally oriented so that an upwardly facing surface of each thereof is located against the bottom section of the bag, on opposite sides of the vertical path, and around opposed sides of the bag discharge opening, said massager paddles being attached to said frame to move from an extended state wherein said are directed towards the bag discharge opening to a retracted state wherein said paddles are spaced from the discharge opening; and an elongate torque arm fixed to and extending in a vertical direction from each said massager paddle and on a side of said respective pivot axis remote from said massager paddle, each said torque arm being oriented in directly opposing relation for movement toward and away from each other about said respective pivot axes; and a single actuator suspended at one end from a first one of said torque arms at a location spaced vertically from said pivot axes and suspended at a second end to the other of said torque arms also at a location spaced vertically from said pivot axes for simultaneously displacing said torque arms and said massager paddles.

13. The massager system of claim 12 wherein said actuator comprises a drive cylinder having a main body with a base end that is suspended to said first one of said torque arms and a retractable piston rod that extends from a second end of said main body, said piston rod being suspended to said second one of said torque arms.

14. The massager system of claim 12, wherein: each said massager paddle is pivotally secured to a mounting arm that is attached to said frame; each said torque arm includes an upstop positioned to abut said mounting arm to limit movement of said massager paddle towards the bag discharge opening and each said massager paddle includes a downstop positioned to abut said mounting arm to limit movement of said massager paddle away from the bag discharge opening.

15. The massager system of claim 14, wherein said actuator is configured to maintain said massager paddles in a maximum position toward the bag discharge opening after further movement of said torque arms and said massager paddles is blocked by said upstops.

* * * * *